US006568438B2

(12) United States Patent
Crossdale et al.

(10) Patent No.: US 6,568,438 B2
(45) Date of Patent: May 27, 2003

(54) DISPENSING APPARATUS

(75) Inventors: Garry William Crossdale, Annesley (GB); Roderick Julian McBrien, Leamington Spa (GB); Cristopher John Webb, Annesley (GB)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/090,964

(22) Filed: Mar. 5, 2002

(65) Prior Publication Data

US 2002/0124907 A1 Sep. 12, 2002

(30) Foreign Application Priority Data

Mar. 6, 2001 (EP) ..... 01302031

(51) Int. Cl.[7] ..... B65B 1/04
(52) U.S. Cl. ..... 141/104; 141/367; 141/172
(58) Field of Search ..... 141/9, 100–104, 141/367, 378, 165, 172

(56) References Cited

U.S. PATENT DOCUMENTS 5,682,930 A * 11/1997 Crossdale ..... 141/104
6,105,633 A 8/2000 Pedersen et al.

FOREIGN PATENT DOCUMENTS

| | | |
|---|---|---|
| EP | 0 675 073 A1 | 10/1995 |
| EP | 0 726 874 B1 | 8/1996 |
| GB | 2 302 087 | 1/1997 |
| WO | 95/12544 | 5/1995 |

* cited by examiner

*Primary Examiner*—Steven O. Douglas
(74) *Attorney, Agent, or Firm*—Neil E. Hamilton; Warren R. Bovee; Renee J. Rymarz

(57) ABSTRACT

The dispensing apparatus dispenses material into a container (34) having at least one predetermined shape component **(40*a*) which cooperates with the dispensing apparatus to control a dispensing operation. There is a vertically movable support (8) for the container having a first, lower position at which the container is brought into a mounted position on the support and a second, higher position, and actuating means (24*a*,30) arranged for mechanical engagement with the container during lifting of the container on the support. The actuating device cooperates with the predetermined shape component or components of the container to determine, in dependence on the shape of the shape component the liquid or liquids to be dispensed into the container, and/or the quantity of a liquid to be dispensed into the container. The actuating device (24*a*,30) lifts cylinders (22,24)** to dispense the liquid.

8 Claims, 10 Drawing Sheets

DISPENSING APPARATUS

FIELD OF THE INVENTION

The invention relates to dispensing apparatus for dispensing materials, such as liquids and powders, into containers in a selective manner. The dispensing apparatus is particularly designed for cooperation with designated containers which have at least one predetermined shape component which cooperates with the dispensing apparatus to control a dispensing operation.

BACKGROUND OF THE INVENTION

In many organisations, for example in industry, in large kitchens and in hotels where many rooms must be cleaned regularly, small containers, such as easily portable bottles, are frequently refilled with cleaning and sanitising liquids from bulk containers held at a filling station. The filling of each container may involve dilution of the liquid contained in the bulk container.

At such a filling station, there may be two or more different liquids stored in bulk and available for dispensing. Different dilutions of one liquid may be required for different purposes. The containers being filled may be labelled or coloured, in order to indicate the liquid which they should contain. There are obvious risks of error here, that the wrong liquid may be filled into a container, particularly when many people frequently visit the filling station. Simple colour coding systems are employed, but do not remove the possibility of human error.

Attempts have been made to overcome this problem by electronic automated filling systems, but these tend to be very complex, involving for example reading of bar code labels. Such systems are expensive and require expert set-up and maintenance.

A simple mechanical control system aiming to achieve filling of a container only with the correct liquid is described in EP-A-675073, where the container has a predetermined profile which corresponds with a specific liquid to be dispensed. Unless slots on the container match projecting pins on a cradle of the dispenser which receives the container horizontally, the container cannot reach the filling position at which it actuates a filling switch on lifting of the cradle. A similar partially mechanical arrangement is shown in EP-A-726874 where movable pins on the cradle, which are selectively depressed by the profiled container as it is pushed onto the cradle, actuate microswitches which through electrical control circuitry cause the desired one among several liquids to be dispensed, when the bottle is lifted in the cradle.

SUMMARY OF THE INVENTION

The present invention seeks to provide a simple and low-cost dispensing apparatus which achieves automatic dispensing of material, such as liquid or liquids, selectively into specific containers, without electronic data handling and even possibly without any electrical control devices.

According to the invention there is provided dispensing apparatus for dispensing material into a container having at least one predetermined shape component selected for cooperation with the dispensing apparatus to control a dispensing operation, the dispensing apparatus having:

(i) a vertically movable support for the container having a first, lower position at which the container is brought into a mounted position on the support and a second, higher position, (ii) actuating means arranged for mechanical engagement with the container during lifting of said container when mounted on the support by movement of the support to said second position thereof, the actuating means being adapted to cooperate with the predetermined shape component or components of the container to determine, in dependence on the shape of the shape component or components, at least one of (a) the material or materials to be dispensed into the container among a plurality of materials available for dispensing (b) the quantity of a material to be dispensed into the container.

Preferably the dispensing apparatus, where used for dispensing liquid, comprises at least one pump having a pumping member movable to pump liquid into the container mounted on the support, the actuating means having an actuating member which is mechanically linked to said pumping member to cause pumping movement thereof and which is arranged to be engaged and moved by one said shape component of the container as the container is lifted by the support, so that the shape of the shape component determines the travel of the actuating member thereby determining the amount of liquid pumped by the pumping member. There may be a plurality of pumps having respective pumping members movable to pump liquid into the container mounted on the support, the actuating means having a plurality of actuating members mechanically linked to the respective pumping members to cause pumping movement thereof and arranged to be selectively engaged and moved by the shape component or components of the container as the container is lifted by the support, so that the shape component or components determines which of said pumping members is moved.

To allow accurate dispensing of different volumes of liquid, using appropriately dimensioned pumps, preferably the amount of liquid dispensed, per unit length of travel of the container when mounted on the support, is larger in a first one of the pumps than in a second one of the pumps. Thus a pump of large capacity can be selected for larger volumes to be dispensed and a pump of smaller capacity for smaller volumes.

In a convenient and simple arrangement, the or each pump comprises a cylinder and piston in the cylinder, the cylinder being the movable pumping member, wherein the upward movement of the support causes upward movement of the cylinder relative to the piston to effect pumping. To improve venting of any air in the pumping system, preferably an outlet path is provided from the cylinder which path extends upwardly from the cylinder to a venting location without a downward path portion, whereby air present in the cylinder tends to be vented therefrom on operation of the pump.

The apparatus preferably includes at least one shut off valve openable to permit dispensing of liquid into the container, and a contact member arranged to be engaged and moved by the container when the container is correctly mounted on the support for a dispensing operation, the contact member being linked to said shut-off valve so as to maintain said shut-off valve closed unless the container is correctly mounted on the support. In this arrangement, said contact member may be arranged to move with said support and to move said actuating member or members on lifting of said support when no container is mounted on the support for dispensing of liquid, thereby moving said pumping member or members so as to cause pumping of the liquid to a storage container or containers therefor.

The dispensing apparatus of the invention can be mechanically simple and can avoid the use of electrical switches and electrical control circuitry. Indeed, the need for electrical power can be eliminated. The natural and necessary action of lifting the container, typically in relation to a dispensing nozzle, is combined with the action of selection by the container shape of the nature and/or quantity of liquid or other material dispensed, and preferably in itself effects the pumping of the liquid.

INTRODUCTION OF THE DRAWINGS

An embodiment of the invention will now be described by way of example with reference to the accompanying drawings, in which.

DESCRIPTION OF THE PREFERRED EMBODIMENTS

Figure 1:
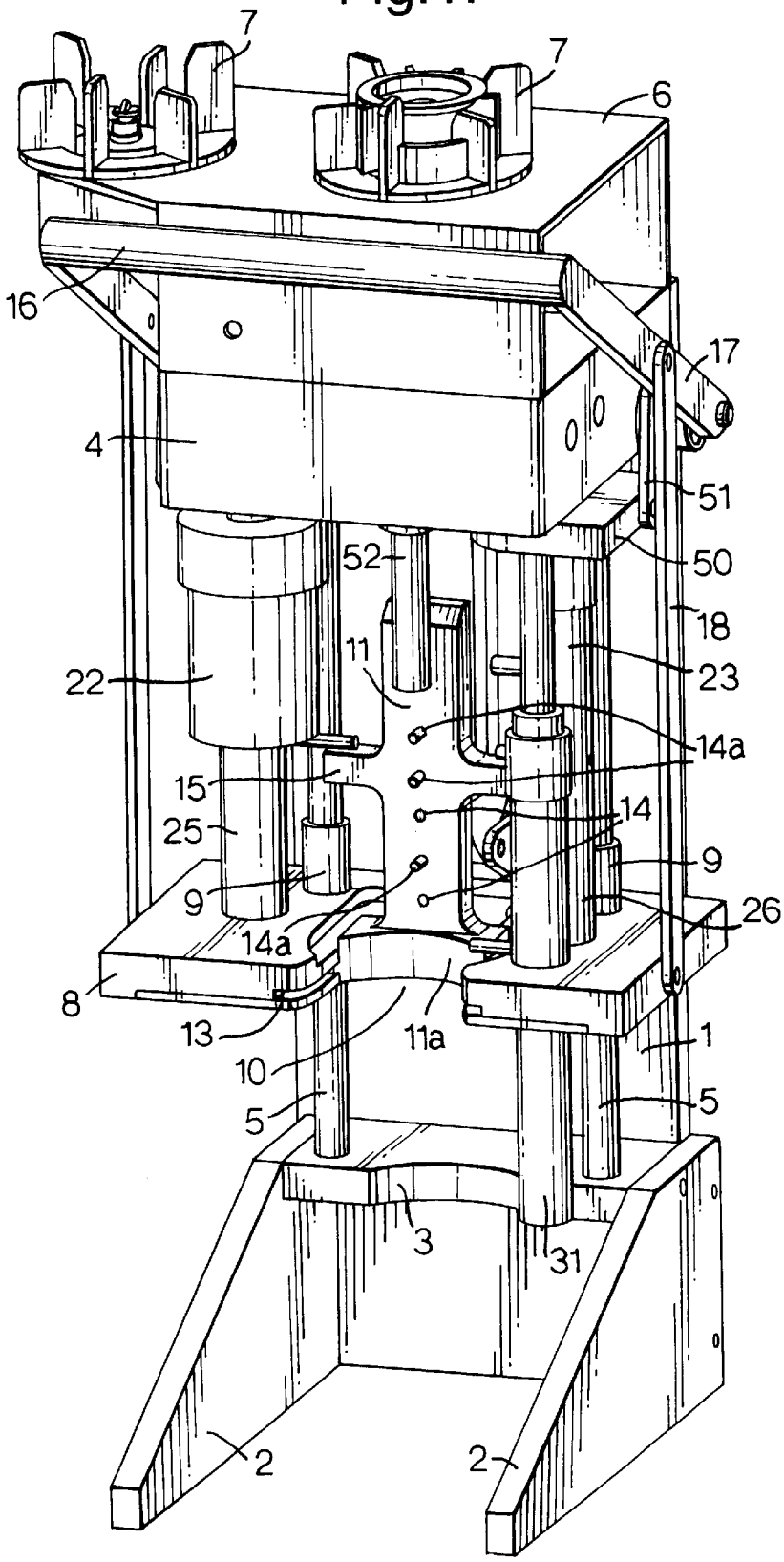
FIG. 1 is a perspective view of the front of a dispensing apparatus embodying the invention, in its "standby" position.

The liquid dispensing apparatus shown in FIGS. 1 to 4 has a fixed frame structure in the form of a vertical back-plate 1, two foot members 2 extending forward to provide stability when 5 the apparatus is standing on a surface (though the apparatus may alternatively be secured to a wall), a cross-plate 3 joining the two foot members 2, a top member in the form of a box 4 containing tubing and valves to be described below and a pair of spaced vertical guide rods 5 connecting the top box 4 with the cross-plate 3. Mounted on the top box 4 is a further box 6 (removed in FIG. 2) and two receivers 7 which in use receive and support inverted bulk containers (not shown) of solutions to be dispensed by gravity. The receivers 7 which are conventional and need not be described in detail are designed to engage the mouth piece of the inverted bulk container and allow outflow, without leakage. The bulk containers may be collapsible, so that the liquid removed does not need to be replaced by air, or may be rigid in which case they must contain a vent.

A cradle 8 for carrying bottles to be filled is carried by bushes 9 which are slidable along the guide rods 5. The cradle 8 has a recess 10 at the rear of which is a vertically extending control plate 11 which at its foot 11*a* has projecting lugs 12 (seen in FIG. 4) engaged in slots 13 of the cradle 8 at the sides of the recess 10, so that the control plate 11 can slide forwardly and backwardly on the cradle 8. The control plate 11 has in its front face a vertical array of five holes 14 in which forwardly projecting pins 14*a* can be selectively placed. Three such pins 14*a* are shown in the figures. The control plate 11 also has a pair of laterally projecting arms 15.

The assembly comprising the cradle 8 and control plate 11, together with other parts connected to the cradle which will be described below, is vertically movable by means of a handle 16 through levers 17, 18 pivotally attached to the top box 4 and the cradle 8. The handle 16 is spring-biased by suitable springs (not shown) to its uppermost position shown in FIG. 1.

Connected to the underside of the top box 4 are three hollow piston rods 19,20,21 (see particularly FIG. 2) and a vertical dispensing tube 52. These are connected by tubing and valves described below to the receivers 7. At their lower ends the piston rods 19,20,21 have respective piston heads of which piston heads 19*a*,20*a* of rods 19,20 can be seen in FIGS. 6 to 10. The piston heads are within respective cylinders, which are a large main dispensing cylinder 22, a small main dispensing cylinder 23 and an auxiliary dispensing cylinder 24. The piston rods 19,20,21 are slidable within the cylinders 22,23,24 when the cylinders are moved vertically, to cause liquid to be drawn into the cylinders on downward movement of the cylinders and to be expelled from the cylinders during upward movement of the cylinders, through hollow passages within the piston rods 19,20,21. The cylinders 22 and 23 have fixed to them downwardly extending rods 25,26 which pass freely through holes of the cradle 8 and end in outward flanges 29 to be seen in FIGS. 6 to 10. The cylinders 22,23 are therefore drawn down by the cradle 8 when it is moved downwardly by means of the handle 16.

Figure 2:
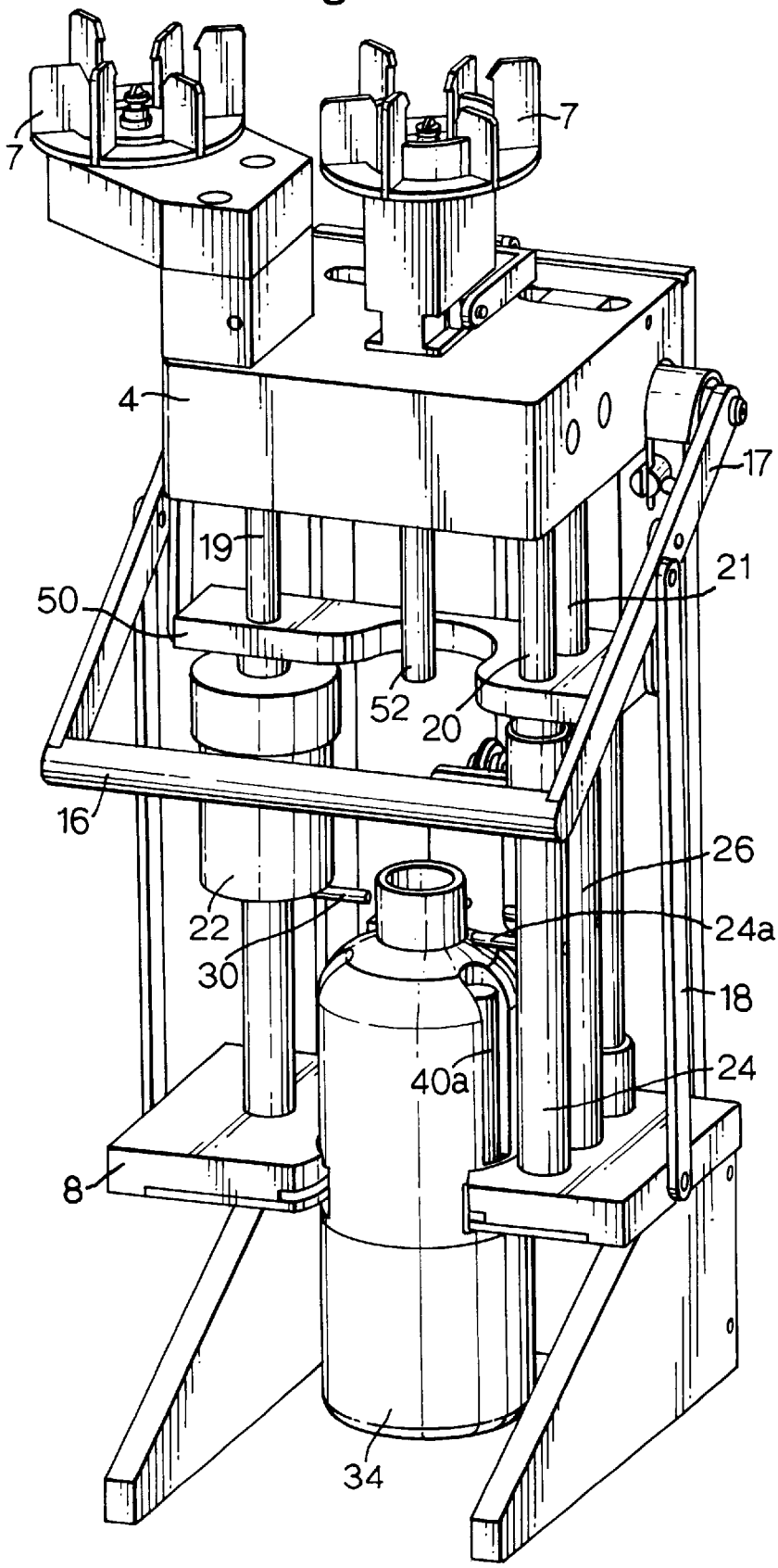
FIG. 2 is a perspective view corresponding to FIG. 1 showing the apparatus including a bottle in one stage of the filling procedure.
Figure 4:
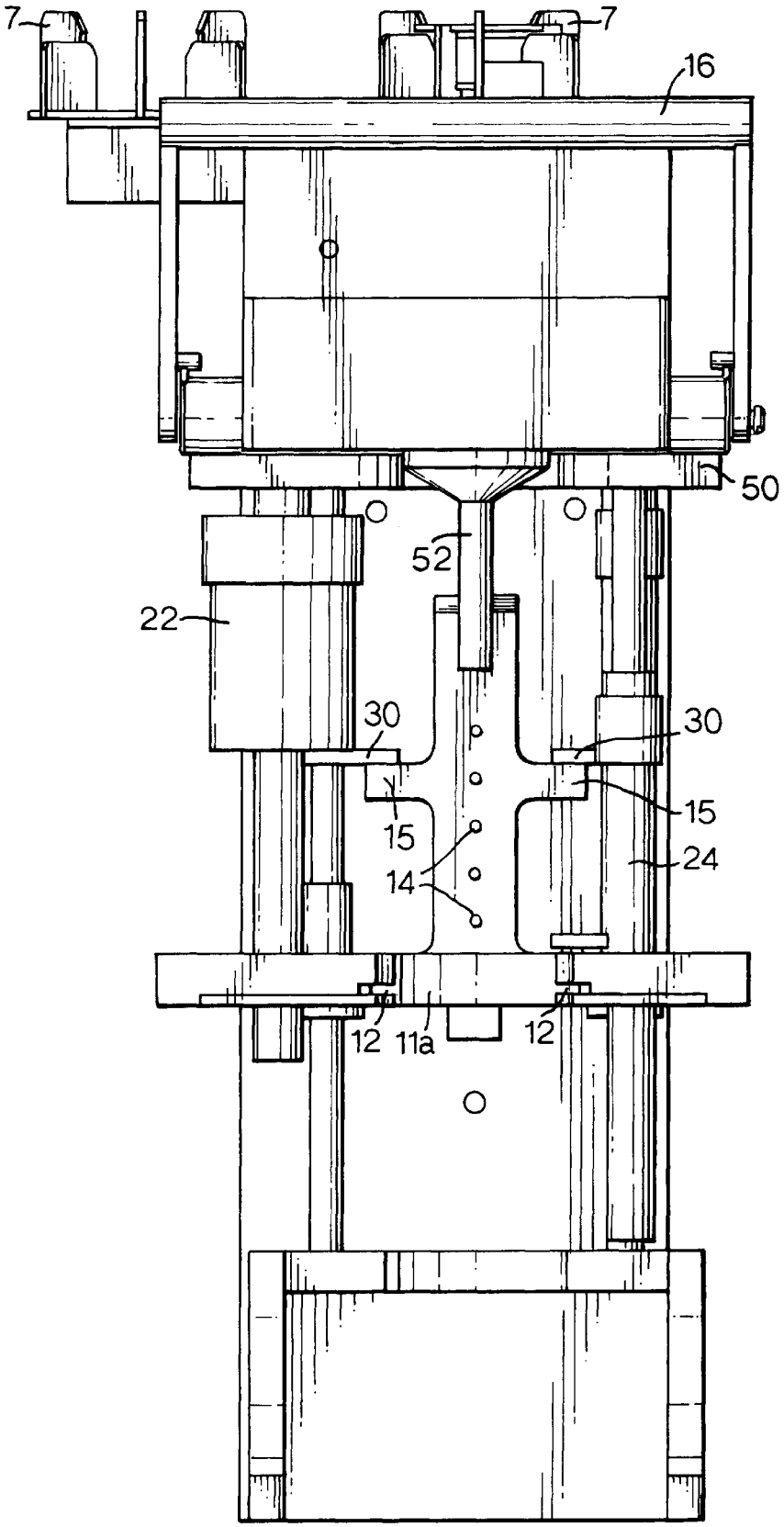
FIG. 4 is a front view of the apparatus of FIG. 1 in its "standby" position.
Figure 5A:
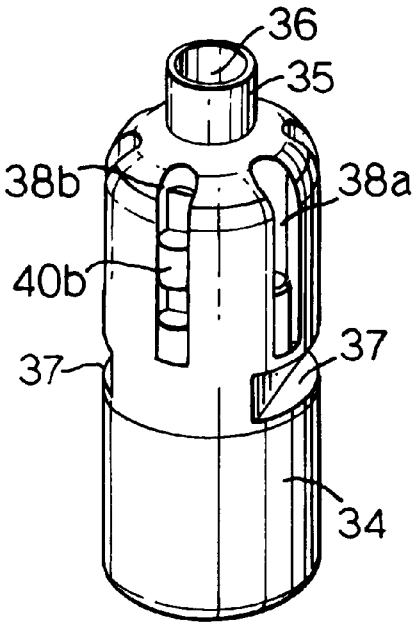
FIGS. 5A to 5D are respectively a perspective view, a rear view, a side view and a top view of an example of a bottle used in conjunction with the apparatus of FIG. 1.
Figure 5B:
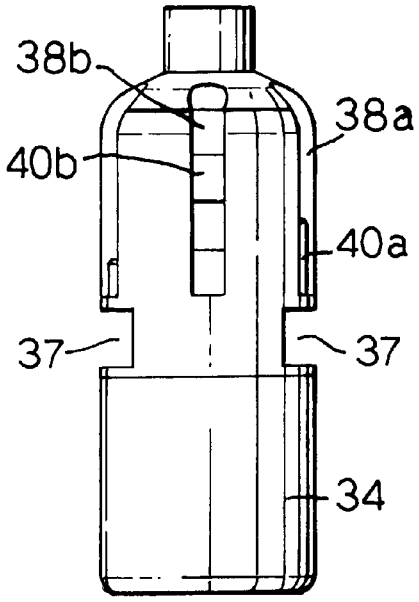
Figure 5C:
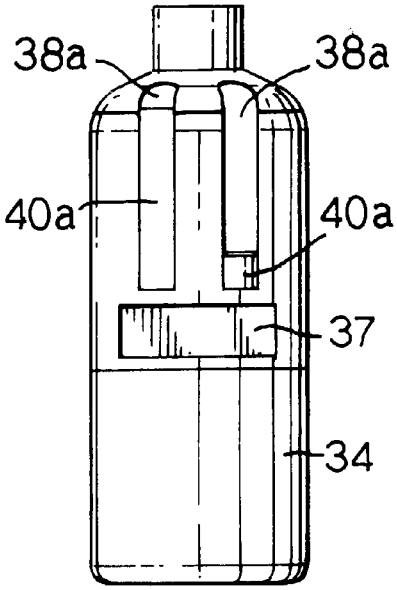
Figure 5D:
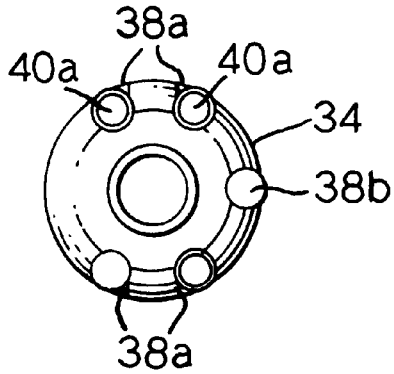

Projecting inwardly from the cylinders 22,23 immediately above the arms 15 of the control plate 11 are projections 30 in the form of pins (see FIGS. 2 and 4. Through these pins 30, the control plate 11 pushes the cylinders 22,23 upwardly, when the control plate 11 is in the appropriate position.

The auxiliary cylinder 24 also has a downward extension 31, which passes freely through a hole in the cradle 8, but unlike the cylinders 22,23, the auxiliary cylinder 24 is not constrained to move downwardly with the cradle 8. The cylinder 24 is vertically slidable along its piston rod 21, to cause liquid to be drawn into it on a downward stroke of the cylinder and the liquid to be expelled from it on the upward stroke, in both cases through the hollow passage of the piston rod 21. Projecting inwardly to a position above the recess 10 is a pin 24*a* fixed to the cylinder 24.

Slidably mounted on the fixed piston rods 19,20,21 is a plate 50 connected to levers 51 joined to the levers 17 carrying the handle 16. When the handle 16 is pulled down, the plate 50 is moved downwardly along the piston rods 19,20,21 to drive the cylinder 24 downwards to its rest position shown in FIGS. 1 to 4 (if the cylinder 24 has previously performed an upward stroke, as described below).

Figure 3:
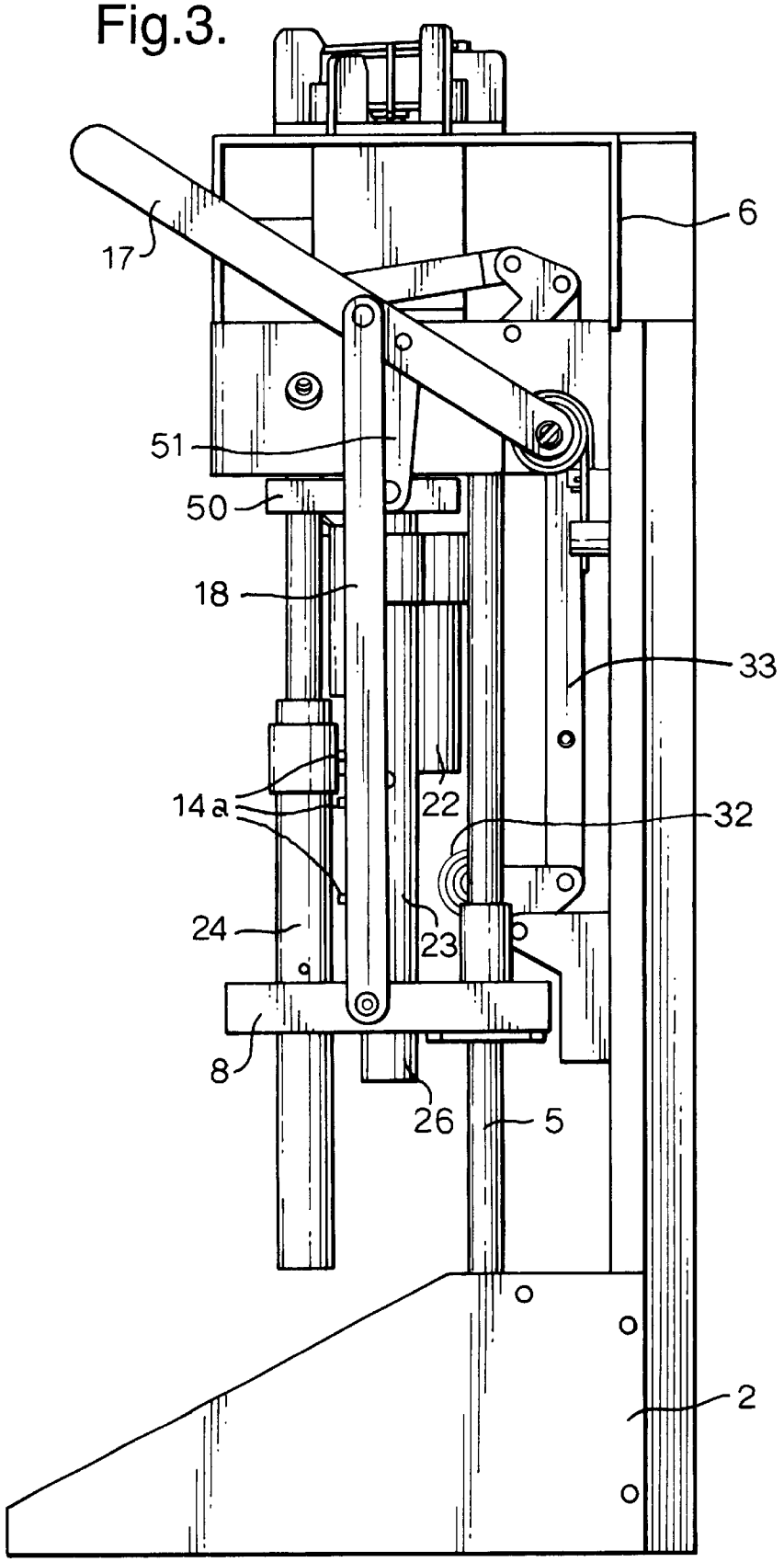
FIG. 3 is a side view of the apparatus of FIG. 1 in its "standby" position.

Rearwardly of the control plate 11 there is a roller 32, seen in FIG. 3, mounted on a lever system 33 which operates a valve in the top box 4, to be described below. Rearward movement of the control plate 11 on the cradle 8 causes the plate 11 to engage the roller 32 and through the levers 33 to operate the valve mentioned. The roller 32 is spring-biased (by means not shown) into its forward position, pushing the plate 11 forwards on the cradle 8.

Next will be described the bottles which are used in conjunction with the dispensing apparatus. FIG. 2 and FIGS. 5A to 5D diagrammatically show one such bottle 34, having a top opening 35 defining a mouth 36 closable by a screw cap (screw thread not shown, and cap not shown). At about the mid-height of the bottle there are two lateral horizontal slots 37, and above them an array of five vertical slots, comprising a pair of lateral slots 38*a* on each side above the recesses 37 and one slot 38*b* at the rear of the bottle 35. As can be seen, each slot 38*a*,38*b* has a circular cylindrical portion which is open at its top end and is open laterally through a gap portion narrower than the diameter of the cylindrical portion. Each slot 38*a*,38*b* can receive an indexing rod 40. The lateral slots 38*a* receive plain cylindrical indexing rods 40*a* of preselected length. The rear slot 38*b* receives an indexing rod 40*b* of predetermined shape having at parts of its length cylindrical portions and at other parts of its length part-cylindrical or notched portions.

Operation of the apparatus will now be described with reference to FIGS. 6 to 10, which for simplicity and clarity show only the operation of the large and small main cylinders 22,23. As FIGS. 6 to 10 show, these are connected through their respective piston rods 19,20 and tubing 41 within the top box 4 via a magnetically operated valve 42 to a solution bulk container 43 mounted on one of the receivers 7. The tubing is also connected via the valve 42 to a non-return valve 44 at the upper end of the dispensing tube 52. FIGS. 6 to 10 also show how the lever system 33, controlled by the roller 32, moves a magnet 45 along a track 46 in the box 4, to control the valve 42.

Figure 6A:
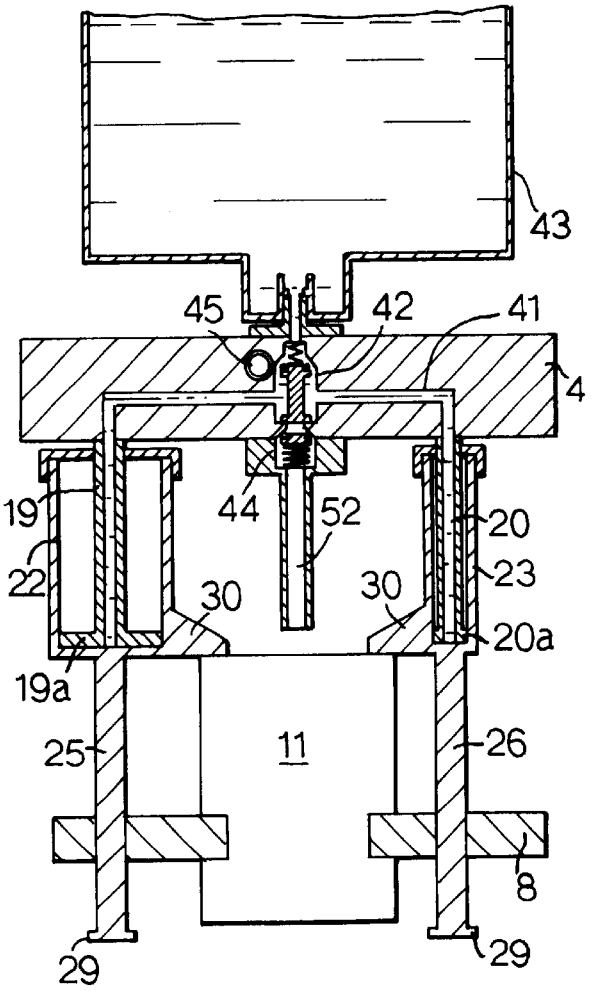
FIGS. 6 to 10 are diagrammatic views of the apparatus of FIG. 1 in sequential stages of the filling procedure, wherein in each drawing the figure with the number suffix A is a front view and the figure with the number suffix B is a side view.
Figure 6B:
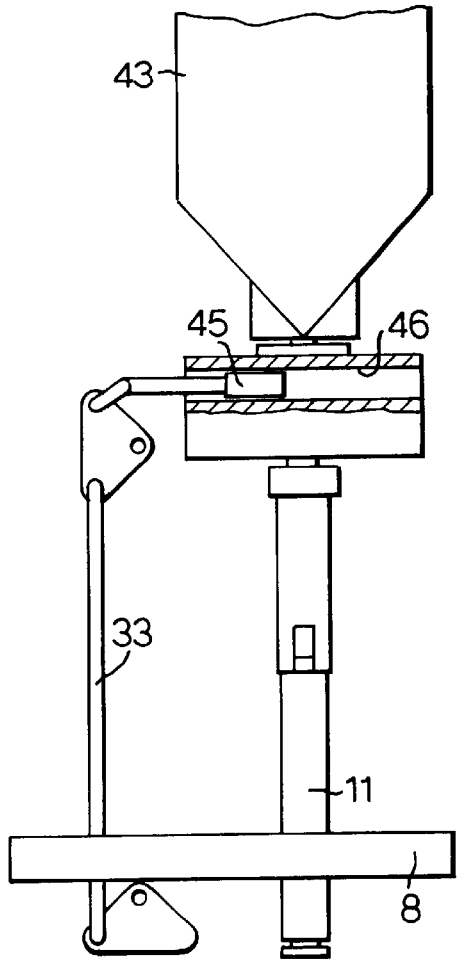
Figure 7A:
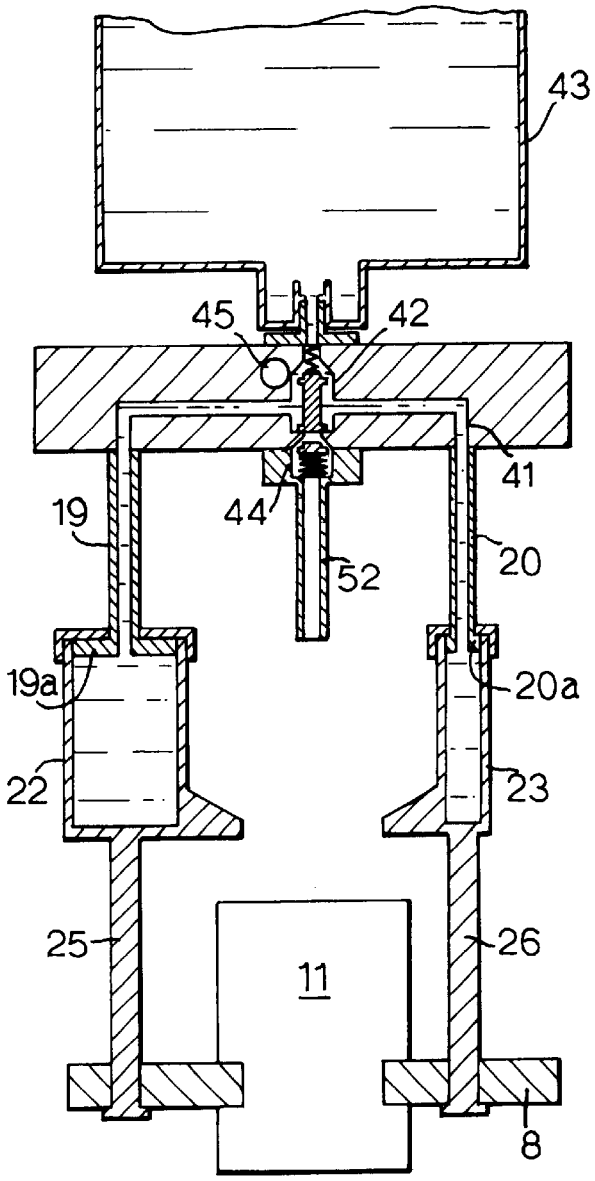
Figure 7B:
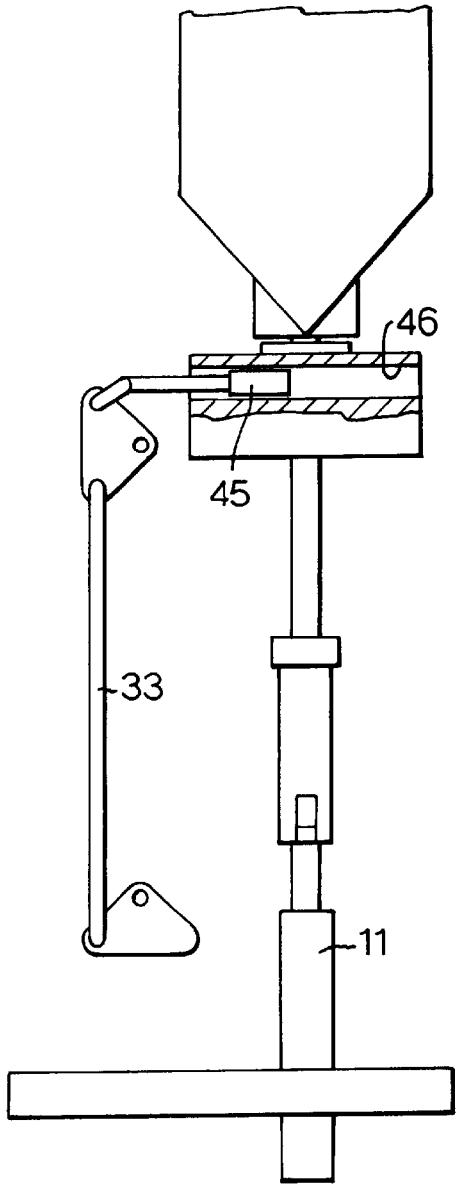
Figure 8A:
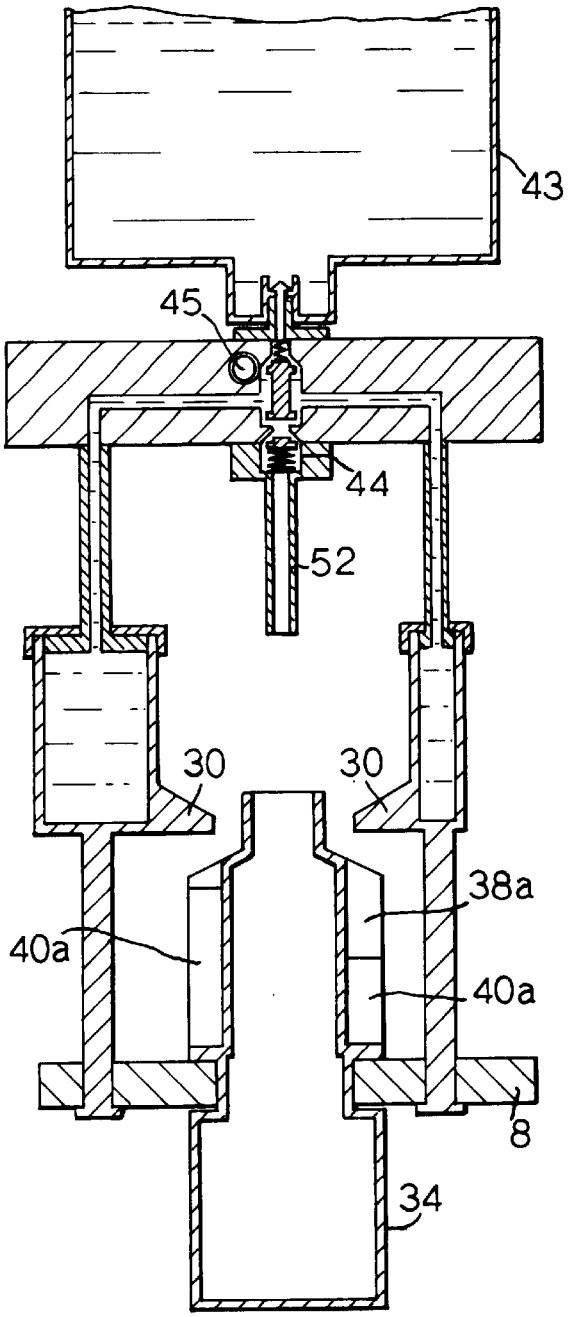
Figure 8B:
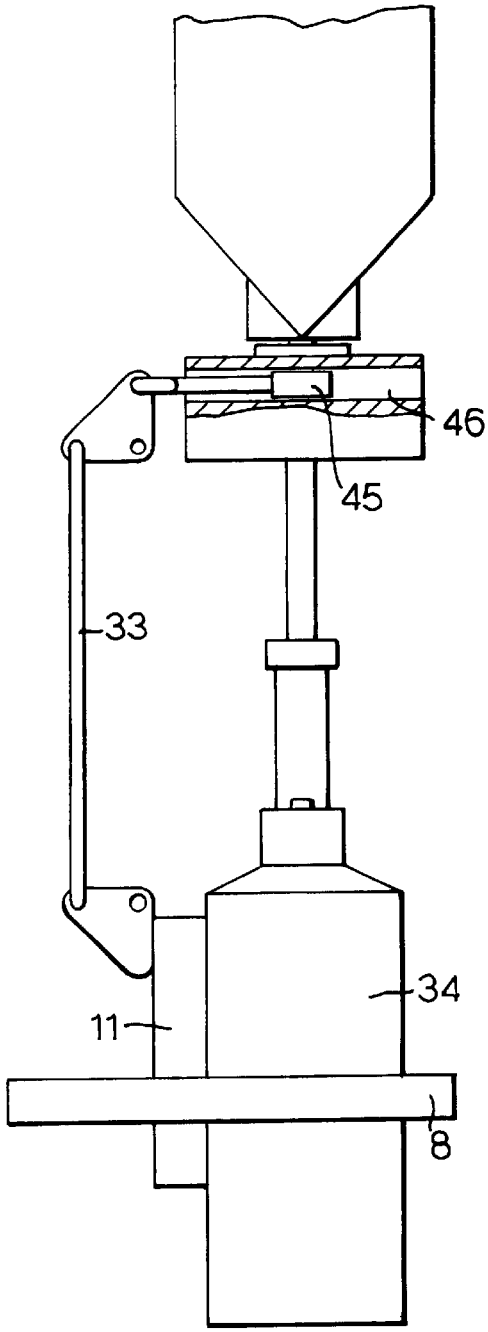

FIGS. 6A and 6B show the "standby" position of the apparatus, in which the cylinders 22,23 are empty and the valve 42 is open. In order to conduct a priming operation of the cylinders and prepare the apparatus to receive a bottle 34 to be filled, the handle 16 is pulled downwardly, moving the cradle 8 and the plate 50 downwards. The cradle pulls the cylinders 22,23 downwardly through the flanges 29, causing the cylinders to fill as shown in FIGS. 7A and 7B. A bottle 34 is then slid into the recess 10 of the cradle 8. As FIGS. 8A and 8B show, the horizontal slots 37 of the bottle 34 allow the bottle to be slid onto the cradle and be supported on the cradle 8.

Pushing the bottle fully into the recess 10 is possible only if the shape of the rod 40*b* in the slot 38*b* at the rear of the bottle matches the pins 14*a* in the holes 14 of the control late 11. That is to say, unless the positions of the part-cylindrical or notched portions of the rod 40*b* match the positions of the pins 14, the bottle cannot be pushed fully into the recess 10, so as to bring its mouth 36 into the correct position below the dispensing tube 52. The operator can perceive that the bottle is not fully pushed into place, and realise that the bottle is not intended to be filled at this dispensing apparatus. The apparatus may be arranged so that a portion of the frame mechanically prevents the bottle from being lifted by the cradle, unless it is correctly positioned. This is useful in the case where more than one dispensing apparatus is in use in an establishment, so that operators can be prevented from attempting to fill a bottle at the wrong dispensing apparatus.

Figure 9A:
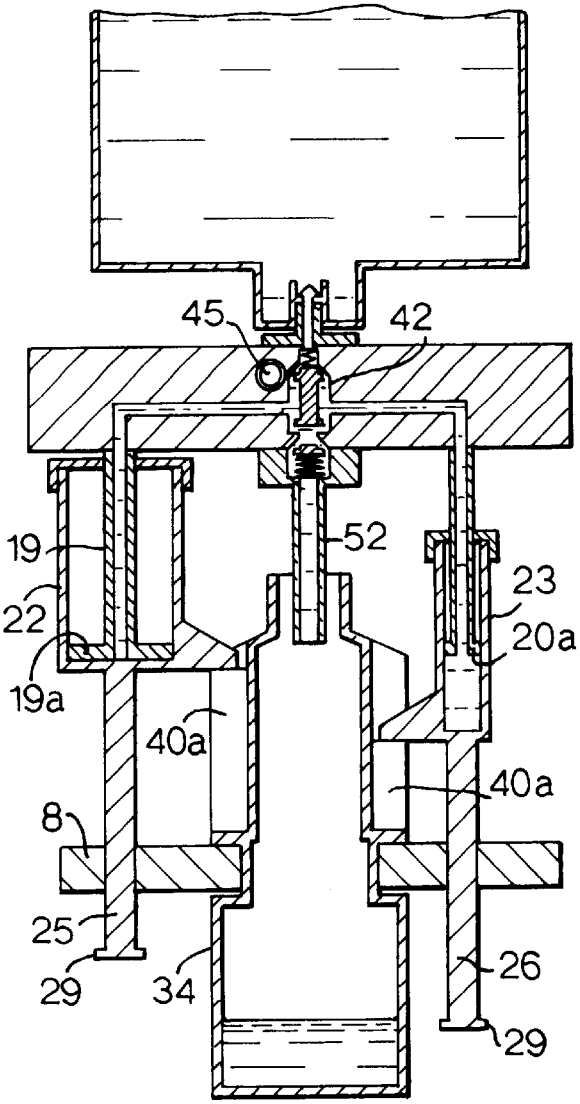
Figure 9B:
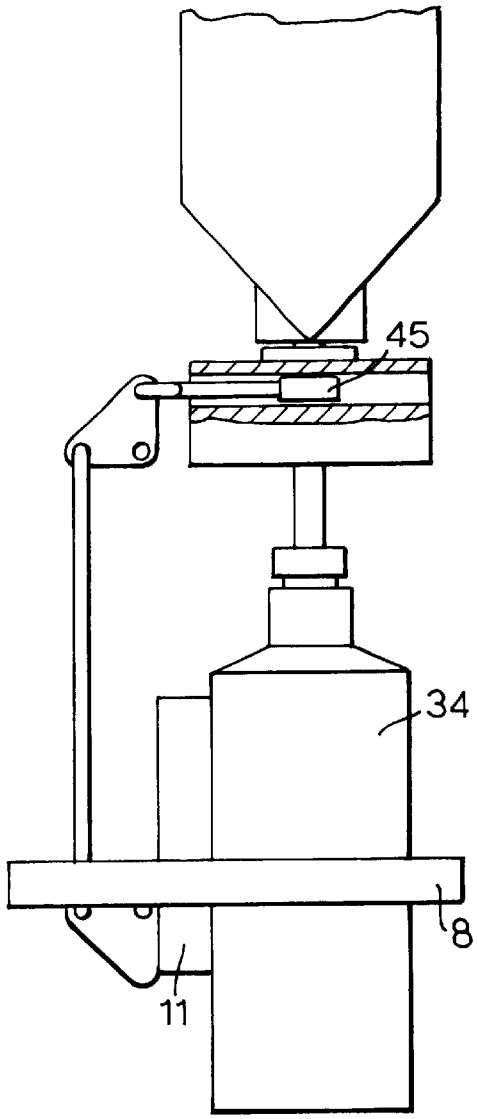

If the bottle is correctly received in the cradle 8, the action of pushing it into the recess 10 causes the control plate 11 to be pushed rearwardly, engaging the roller 32 and through the levers 33 moving the magnet 45 which causes the valve 42 to close. The apparatus is now ready to dispense liquid from one or both of the cylinders 22,23 into the bottle. As FIGS. 9A and 9B show, upward movement of the cradle carries the bottle upwardly, with the valve 42 being maintained shut. As the bottle rises, the pins 30,31 of the cylinders 22,23 enter the rearward pair of the lateral slots 38*a* of the bottle 35. When the pins 30,31 are engaged and how much they are lifted by the bottle depends upon the lengths of the rods 40*a* in these slots. A full height rod 40*a* shown at the left-hand side of FIG. 9A causes full upward travel of the large cylinder 22 along its piston rod 19, resulting in dispensing of a volume of liquid corresponding to the full travel of the large cylinder 22, through the non-return valve 44 into the bottle. As shown at the right-hand side of FIG. 9A, a half-length rod 40*a* causes upward movement of the small cylinder 23, by engagement of the rod 40*a* with the pin 31, during the upper half of the travel of the cradle 8. This dispenses a half-volume of the cylinder 23 through the non-return valve 44 into the bottle. If a rod 40*a* is absent in the respective slot 38*a*, the cylinder 22 or 23 will not be operated by the bottle at all.

It can easily be seen how choice of the rods 40*a* allows a desired amount of the solution from the bulk container 43 to be dispensed into the bottle.

Figure 10A:
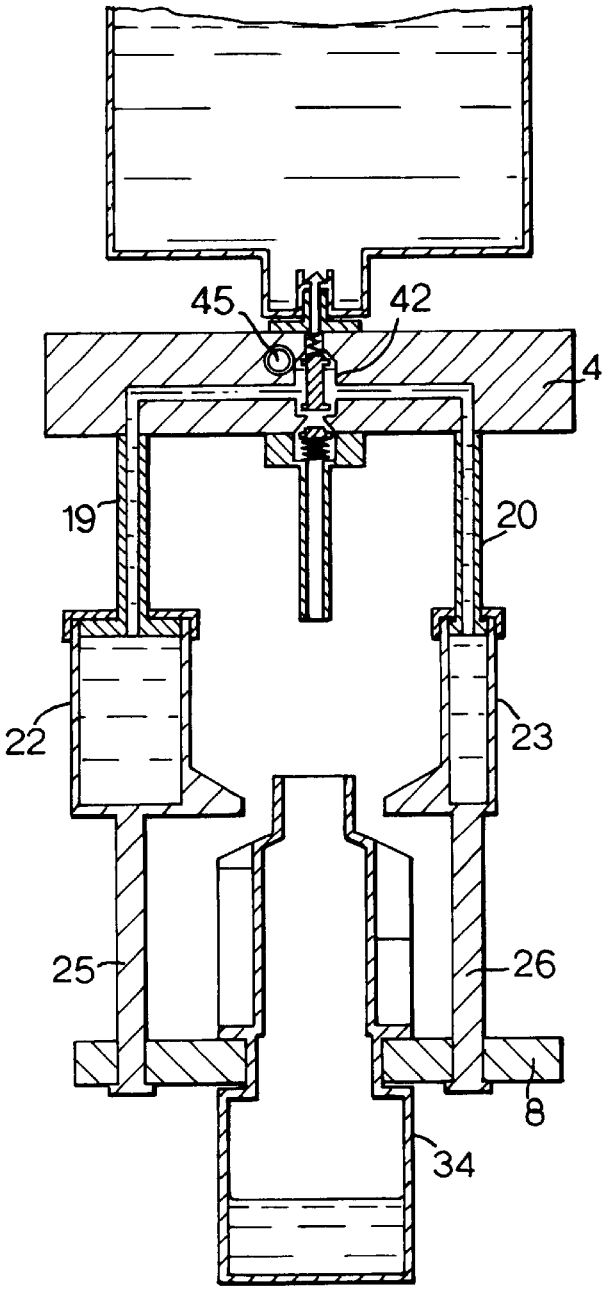
Figure 10B:
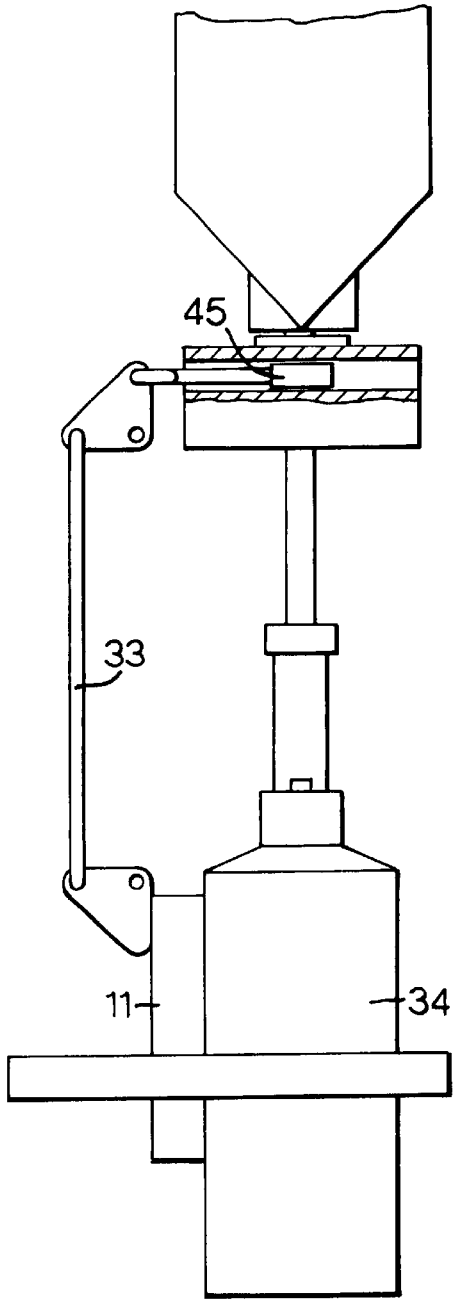

To enable the bottle to be removed after filling, the cradle 8 is moved down again through the lever 16, as shown in FIGS. 10A and 10B, with the consequence of re-filling of the cylinders 22,23 (if emptied or partially emptied). The bottle is then removed, allowing the control plate 11 to move forwardly pushed by the roller 32 under its spring bias and thereby opening the magnetic valve 42. Release of the handle 16, which is spring loaded upwardly, causes the cradle to move upwardly again to the standby position of FIGS. 6A and 6B. During this upward movement, the control plate 11 which is now in its forward position, engages the pins 30,31 through its arms 15, to draw both the cylinders 22,23 fully upwardly, expelling the liquid from the cylinders through the open magnetic valve 42 to the container 43. This refilling and emptying of the cylinders 22,23 as the bottle 34 is removed back to the container causes a flushing operation which purges from the system any air which may have entered, e.g. when a container 43 becomes empty and is exchanged.

It is also possible to perform a priming operation simply by pulling the lever 16 downwards to fill the cylinders 22,23, and then allowing the cradle 8 to return upwardly without placing a bottle on it. This has the action of filling the cylinder 22,23 and then emptying them back to the container since the valve 42 remains open. Flushing the cylinders, tubing and valve in this manner ensures that the system is operating correctly and that the full amount of liquid is filled into the cylinders during the subsequent filling operation. This is especially advantageous after a container 43 is replaced, in order to avoid that air is partially or wholly dispensed from the cylinders 22,23 instead of liquid.

The apparatus may include a mechanism to prevent an operator pulling the handle down twice, when a bottle is in place, i.e. to try to prevent a repeated filling operation on one bottle. However, this does not prevent the operator from removing the bottle and replacing it again to obtain a double filling.

The solution filled in this embodiment is a concentrated one, so that the bottle is only partially filled. It is intended that the bottle will then be filled by the operator to its normal fill level with plain water, to dilute the concentrated solution, before use.

The presence of the two main cylinders 22,23 having different diameters, allows the accurate dispensing of either small amounts, e.g. 0.5–5 ml, of liquid from the bottle 34, using the small cylinder 23 or larger amounts, e.g. 60 ml, using the large cylinder 22 or both cylinders 22,23, as desired. Accuracy of dispensing of both small amounts and large amounts cannot be easily achieved using a single cylinder.

The auxiliary cylinder 24 is intended to allow selective filling of a second liquid from a second container mounted on the second receiver 7. This second liquid is for example a perfume solution, or a chemical additive which for example may be an additive which has a limited effective life when admixed with one of the other components and/or with water. Unlike the cylinders 22,23, the cylinder 24 remains normally in the down position, and is not moved upwardly by the cradle 8 and control plate 11. It is moved upwardly by its pin 24*a* engaging a rod 40*a* in the appropriate front slot 38*a* of the bottle 35. If a rod 40*a* is not present in the appropriate front slot 38*a*, the pin 24*a* is not engaged, and the cylinder 24 is not operated, so that the relevant liquid is not dispensed into the bottle. The cylinder 24 is connected to the dispensing tube 52 via tubing (not shown) and an outlet non-return valve (not shown). There is a second, inlet non-return valve between the cylinder 24 and the second container mounted on the second receiver 7. If the cylinder 24 is raised partially or wholly by the bottle 34, it is returned to its downward rest position shown in FIG. 1 by the movement of the plate 50 when the handle 16 is next pulled down to refill it.

The arrangement of the pumps constituted by the cylinders 22,23 and their piston and their associated liquid flow paths is advantageous in several ways. In the rest or "standby" position of the apparatus, with the cradle 8 and control plate 11 at their upper position, the cylinders 22,23 are at their uppermost position also relative to the piston heads 19*a*,20*a*, and an open passage exists upwardly, without any downward portion, through the piston rods 19,20, the pipework and the open valve 42 to allow venting of any air in the cylinders to the atmosphere, e.g. to the head space above liquid in the container 34. Furthermore, the risk of dispensing of air, rather than liquid, following replacement of an empty container 34 by a full one, is minimized. Any air which has entered the cylinders or pipework can be easily flushed out of the system by a preliminary operation of the pumping action of the cylinders 22,23 without a bottle in place on the cradle, as described with reference to FIGS. 10A and 10B. During this operation air will collect at the top of the cylinder and be vented out of the cylinder into the bottle 34 first, followed by liquid. It is thus ensured that in a subsequent dispensing operation, even one in which only a small amount of liquid is to be dispensed, e.g. by partial travel of the small cylinder 23 as shown in FIG. 7A, the correct amount of liquid is dispensed into the bottle since the cylinder is correctly filled with liquid without any entrapped air being present.

We claim:

1. Dispensing apparatus for dispensing material into a container having at least one predetermined shape component selected for cooperation with the dispensing apparatus to control a dispensing operation, the dispensing apparatus having:

(i) a vertically movable support for the container having a first, lower position at which the container is brought into a mounted position on the support and a second, higher position, (ii) actuating means arranged for mechanical engagement with the container during lifting of said container when mounted on the support by movement of the support to said second position thereof, the actuating means being adapted to cooperate with the predetermined shape component or components of the container to determine, in dependence on the shape of the shape component or components, at least one of (a) the material or materials to be dispensed into the container among a plurality of materials available for dispensing (b) the quantity of a material to be dispensed into the container.

2. Dispensing apparatus according to claim 1, for dispensing one or more liquids, comprising at least one pump having a pumping member movable to pump liquid into the container mounted on the support, the actuating means having an actuating member which is mechanically linked to said pumping member to cause pumping movement thereof and which is arranged to be engaged and moved by one said shape component of the container as the container is lifted by the support, so that the shape of the shape component determines the travel of the actuating member thereby determining the amount of liquid pumped by the pumping member.

3. Dispensing apparatus according to claim 1, comprising a plurality of pumps having respective pumping members movable to pump liquid into the container mounted on the support, the actuating means having a plurality of actuating members mechanically linked to the respective pumping members to cause pumping movement thereof and arranged to be selectively engaged and moved by the shape component or components of the container as the container is lifted by the support, so that the shape component or components determines which of said pumping members is moved.

4. Dispensing apparatus according to claim 3, wherein the amount of liquid dispensed, per unit length of travel of said container when mounted on said support, is larger in a first one of said pumps than in a second one of said pumps.

5. Apparatus according to claim 1, wherein the or each said pump comprises a cylinder and piston in the cylinder said cylinder being the movable pumping member, wherein the upward movement of said support causes upward movement of the cylinder relative to the piston to effect pumping.

6. Apparatus according to claim 5, wherein an outlet path is provided from said cylinder which extends upwardly from the cylinder to a venting location without a downward path portion, whereby air present in the cylinder tends to be vented therefrom on operation of the pump.

7. Dispensing apparatus according to claim 1, having at least one shut off valve openable to permit dispensing of liquid into the container, and a contact member arranged to be engaged and moved by the container when the container is correctly mounted on the support for a dispensing operation, the contact member being linked to said shut-off valve so as to maintain said shut-off valve closed unless the container is correctly mounted on the support.

8. Dispensing apparatus according to claim 7, wherein said contact member is arranged to move with said support and is arranged to move said actuating member or members on lifting of said support when no container is mounted on the support for dispensing of liquid, thereby moving said pumping member or members so as to cause pumping of the liquid to a storage container or containers therefore.

* * * * *